United States Patent [19]

Sura

[11] Patent Number: 4,932,634

[45] Date of Patent: Jun. 12, 1990

[54] PLASTIC SNOW FENCE SYSTEM

[76] Inventor: Andrew Sura, R.R. #5, 79 Wildwood Rd., Georgetown, Ontario, Canada, L7G 4S8

[21] Appl. No.: 268,282

[22] Filed: Nov. 7, 1988

Related U.S. Application Data

[63] Continuation-in-part of Ser. No. 165,558, Mar. 9, 1988, abandoned.

[51] Int. Cl.[5] ..... E04H 17/00

[52] U.S. Cl. ..... 256/12.5; 256/48

[58] Field of Search ..... 256/12.5, 52, 48

[56] References Cited

U.S. PATENT DOCUMENTS

| | | | |
|---|---|---|---|
| 1,778,073 | 10/1930 | Gish | 256/52 |
| 2,795,399 | 6/1957 | Anderson | 256/12.5 |
| 2,872,161 | 2/1959 | Olson | 256/12.5 X |
| 3,606,259 | 9/1971 | Farrell | 256/48 |
| 4,191,361 | 3/1980 | Jensen | 256/12.5 |

FOREIGN PATENT DOCUMENTS

| | | | |
|---|---|---|---|
| 2414737 | 10/1975 | Fed. Rep. of Germany | 256/12.5 |

*Primary Examiner*—Andrew V. Kundrat

*Attorney, Agent, or Firm*—Blake, Cassels & Graydon

[57] ABSTRACT

A snow fence system utilizes horizontal plastic slat fence elements of a wide plastic ribbon supported in uniformly spaced relation by fence posts equipped with ribbon attachment ears. The spacing between the slats may be sustantially equal to the slat widths, and the post attachment cleat permit attachment of the fence elements in self-binding relation, with individual tensioning of the slat span from post to post. The system offers a superior type of snow fence at significant cost savings in both material and labor.

13 Claims, 4 Drawing Sheets

PLASTIC SNOW FENCE SYSTEM

RELATED APPLICATIONS

This invention is a continuation-in-part of U.S. patent application No. 165,558, filed 3/9/88, to be abandoned on filing of the present application.

BACKGROUND OF THE INVENTION

1. Field of the Invention

This invention is directed to a fence system and in particular to a novel fence post, a fence incorporating the post, being particularly suited for use as a snow fence, and to a method of erection thereof.

2. Background of the Invention

Widespread use is made in northern climates of snow fences. Snow fences are located to afford protection to selected areas, such as roads, etc., against drifting snow.

Snow fences operate by generating local turbulences in the prevailing wind, on passing through the elements of the fence, causing depostion of wind-born snow on the downwind side of the fence.

The best known and most widely used snow fence has been the vertically slatted fence, having wooden slats of about four feet in length carried upon twisted wire strands and supported between uniformly spaced fence posts. The slatted wooden fence normally is provided in fifty feet lengths, which forms an optimum sized roll constituting a suitable 2-man load.

Snow fences are erected to extend parallel with a road or other area being protected, and are generally located some 200 feet distant, upwind of the area to be protected against drifting. This generally causes them to be erected upon private property, and largely for this reason and by the fact of their location some way into fields and other areas bordering the road, it is usually imperative to install and remove the fences annually, on a seasonal basis.

Thus, the fence posts must be driven and the fences strung in late fall, and the process reversed, by removal thereof in the spring.

Owing to the significant bulk and not inconsiderably clumsiness of handling of the wood slat snow fences, their erection or removal requires the provision of truck transportation upon the land at climatically inopportune times, and the provision of three or four-man work crews is commonplace. One thousand feet of wood slat snow fence constitutes a normal truck load, of some twenty bulky rolls.

The performance of snow fences has received considerable theoretical study, both in Canada and the United States, including wind tunnel experiments of their characteristics and effectiveness. From the work of Threakston of Guelph University, Ontario, Canada and others, it appears to be fairly generally accepted that an ideal fence arrangement provides a 50/50 coverage, i.e., one half of the projected area of a section of fence is made up of a suitable form of slat, the other half of that area coverage comprising the space between adjacent slats.

It has been found that vertical slats tend to cause precipitation of snow unduly close to the fence line, with consequent loss of effectiveness, due to the formation of a deep drift immediately adjacent the fence line. In heavy snow fall areas, this can lead to a subsequent requirement to provide a second line of fence located upon the top of the first-formed drift, in order to maintain effective drift control. Timing of this requirement at the height of the snow season is most inopportune, and placement of the fence most awkward.

In contrast, snow fences of the type having horizontal slats have a more protective effect, thus generating snow deposition on a wider basis, with consequent delay in the build-up of a leeward bank, and thus extending the effectiveness of the snow fence.

The use of plastics for snow fencing is coming into its own. However, the matter of securing a net-like fencing to its supporting posts appears to have made little advance. The preferred known method appears to involve the use of a wood slat, sandwiching the net-like fencing between a wood strip and the fence post. This in turn generally requires that the fencing be tensioned for each span, as it is progressively nailed to the supporting posts, which constitutes a labour intensive operation.

The use of a horizontal plastic slat is known, in an embodiment utilizing a six inch width polyester tape as the slat. However, due to the material used, such slat provision is expensive, costing about one dollar Canadian per linear foot for a four slat polyester arrangement, exclusive of posts or post attachment systems. A like cost figure for the more usual vertical wood slat fencing would be in order of thirty-five cents to fifty cents Canadian per linear foot.

In addition, cost are further escalated, in the case of plastic "net" fences and polyester slat fencing, by the post attachment costs of the securing slats, and labour for this attachment.

SUMMARY OF THE INVENTION

In accordance with the present invention there is provided an elongated fence post having a lower portion for driving into the ground and an upper portion of predetermined length having a plurality of elongated cleat portions extending generally parallel with the post and forming therewith a series of slots, in use to receive wide ribbons in inserted relation therein, the so-formed slots being located in mutually spaced apart relation a predetermined distance.

Preferably the fence post comprises a T-bar having cleats mounted thereon in spaced vertical relationship, each cleat being adapted to support fence slatting of plastic tape and each cleat comprising an upstanding leg of height at least as great as the width of the tape connected to the T-bar by attachment means via a web such that the leg be parallel with the T-bar separated from it by a slot.

Also according to the invention is, in a fence system incorporating a T-bar fence post in combination with a tape having a width suitable for use as a fence slat; cleats adapted to be mounted on the T-bar in spaced vertical relationship one with another, each cleat comprising a leg of a height at least as great as the width of the tape, said leg adapted to lie substantially parallel with the T-bar and a web adapted to space the leg from the T-bar between the leg and the T-bar, attachment means being provided on each cleat to attach it to the T-bar.

Also according to the invention is a method of erecting a horizontal slat fence on spaced apart posts each comprising a T-bar having a windward side and a leeward side, cleats being mounted thereon by by mounting means in spaced vertical relationship, each cleat comprising an upstanding leg parallel with the T-bar and spaced therefrom by a web; comprising forming a slat by looping a first bight of a first slat tape around the windward or the leeward side of one post, engaging the apex of the first bight on a cleat of said one post, extending a single length of tape emerging from the first bight around the other of the windward and leeward sides of the first post, and similarly looping a second bight of tape around the corresponding side of T-bar, engaging the apex of the second bight on a corresponding cleat of the second post, and tensioning the resulting slat by adjusting the location of the apex of the second bight.

In one embodiment the cleats generally are struck out of the web flange or leg of the T-bar, by removal of the adjoining portion of the material thereof. It is preferred the cleats may be affixed in extending relation from the body of the T-bar. Thus, the provision of a plurality of spot welded stiff wire cleats for the defined purpose is considered to lie within the ambit of the present invention. More importantly the cleats may be provided as a separate unit or units which may be mounted on the T-bar by a bolt on the unit which extends through a hole in the leg of a T-bar.

In carrying out the method, the torquing effect applied on a selected fence post by wrapping a tensioned loop having the loop end in secured relation to an eccentric cleat, may be off-set by wrapping the loop of an upper or lower fence slat about the post in the reversed sense. Thus in the case of a four foot snow fence having four six-inch wide ribbon or tape slats mounted in the post cleats in accordance herewith, two of the four ribbons can be wound on (i.e., have the bights applied) in a clockwise sense, and two can be wound on in an anti-clockwise sense. In this manner there is substantially no consequent, unbalanced torque applied against the post, thus minimizing the loosening forces acting on the post. Owing to the subject system requiring no crimping or knotting of the slat ribbons, these ribbons may be rapidly applied and tensioned and as rapidly retrieved in a substantially undamaged condition at the end of the season.

It will be appreciated that the logistics backup for transporting and erecting the elements of such snow fencing are markedly reduced. Using a suitable low cost tape of reclaimed or virgin plastic, significant material cost savings can also be effected.

As the tape is readily carried by one man in a four hundred foot or five hundred foot roll, in place of requiring tape-to-tape attachment means between such fence segments, an adjoining post may be used to effect the end attachment.

Generally, however, adjoining ribbons are overlapped at one of the posts to a sufficient extent such that the ribbon ends are effectively trapped by the mutually self-locking bight, formed in the fashion explained.

BRIEF DESCRIPTION OF THE DRAWINGS

Certain embodiments of the invention are described by way of example reference being made to the accompanying drawings, wherein.

DETAILED DESCRIPTION OF THE EMBODIMENTS OF THE INVENTION

Figure 1:
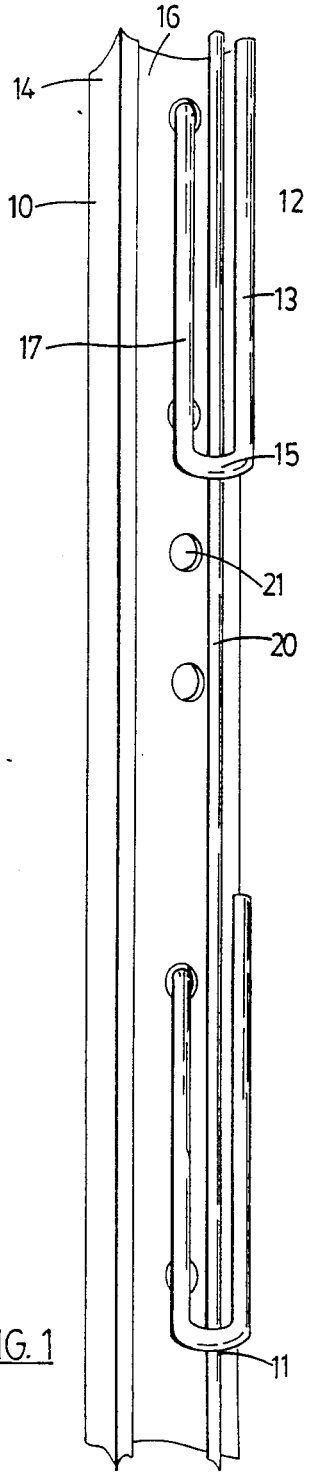
FIG. 1 is a side elevation of a length of a fence post incorporating cleats for supporting tape, the post being viewed from one side.
Figure 2:
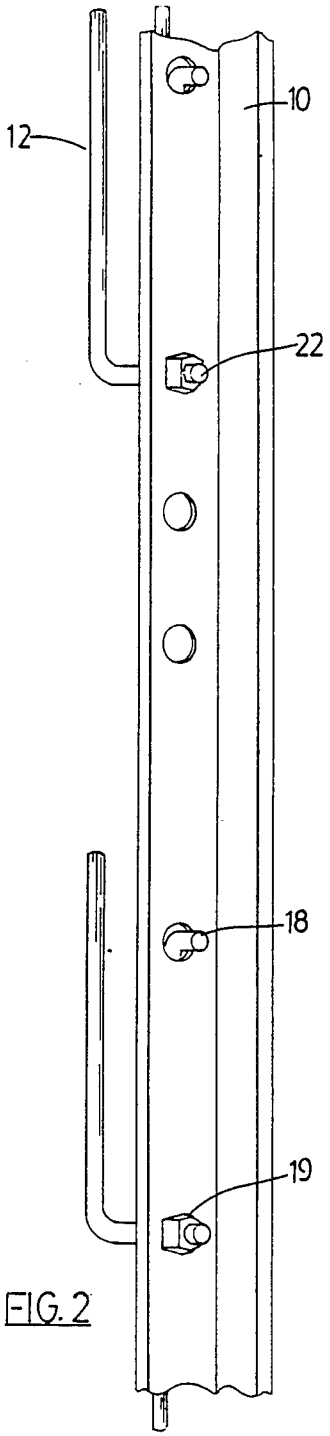
FIG. 2 is side elevation similar to that of FIG. 1 but viewed from the other side of the post.

Referring to FIGS. 1 and 2 there is illustrated a T-bar post 10 having a plurality of cleat portions 12. The T-bar has a main or top flange 14, and a leg 16 on which the cleat portions 12 are supported.

Figure 4:
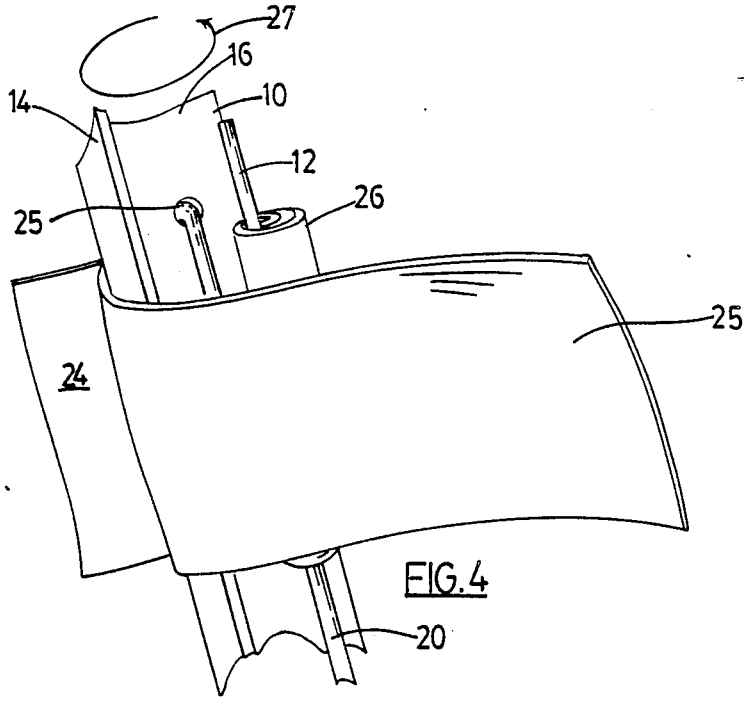
FIG. 4 is a general view, in detail, of a first wrap on a post of FIGS. 1 and 2.
Figure 5:
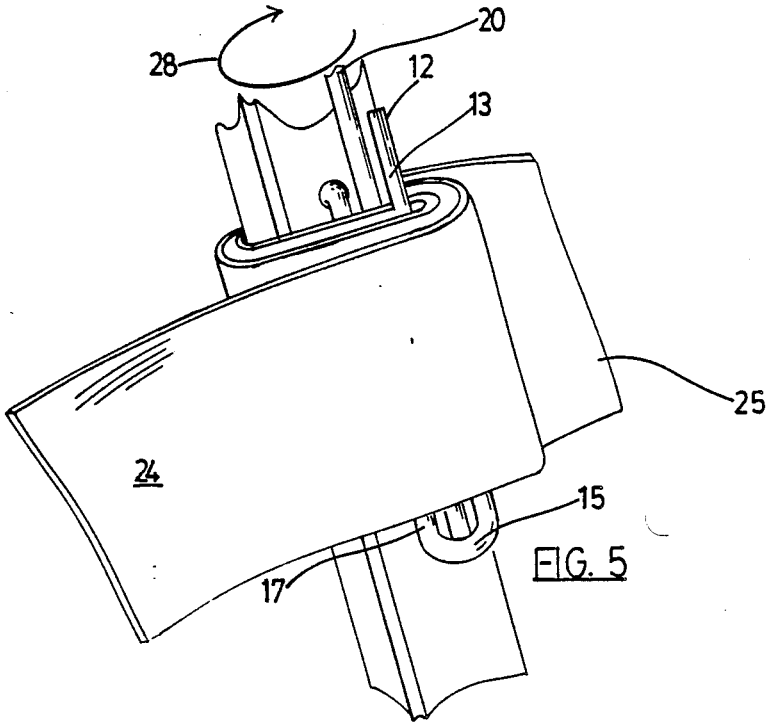
FIG. 5 is a like view to FIG. 4 showing a second, reverse wrap.

The post of FIGS. 1, 4 and 5 is a conventional T-bar having holes through the leg 16 of the T for stringing fence wires, or for the location of wire ties if sheep or pig wire is used, or for other purposes. The T-bar 10 is provided with a cleat fitting 12. In its simplest form the fitting 12 comprises cleats, each comprising an upstanding leg 13 and a web 15. The cleat is fixed to the T-bar by means of a bolt 22 which passes through one of the holes 21 in the leg 16 of the T-bar and is held firmly in position by a nut 19. The cleats are spaced apart vertically in equal steps and each cleat defines a slot between the cleat leg 13 and the leg 16 of the T-bar. Preferably, as shown, the vertically spaced apart cleats are connected as a single fitting by a vertical spacing bar 20. This spacing bar 20 is suitably welded to the web 15 of each cleat 12. To provide even greater stability of the cleats, a second cleat leg 17 adjacent the leg 16 of the T-bar 10 may be provided so that each cleat 12 comprises a U-member. The top end of the leg 17 is bent over to form a hook 18 which fits into one of the holes 21 of the T-bar. The bolt 22 is welded onto the leg 17 and spaced from the hook 18 a distance such that the hook 18 and the bolt 22 pass through holes 21 of the T-bar 10 locating the cleat 12 very firmly with respect to the T-bar. The cleats 12 and the spacing bar 20 may conveniently be made from quarter inch rod.

The cleat fitting may be used in connection with existing wire fences where the wire fences are supported by T-bars. It may also be provided separately from T-bars for fitting thereto. Thus, the user who has ready supply of T-bars at his disposal, may need only to buy the tape or ribbon and the fittings to enable him to erect a snow fence. Once the cleat fittings have been mounted on the T-bar, they need not interfere with the operation of the T-bar for other purposes. Thus, it seems likely that once the cleat fitting has been mounted on a T-bar, it will be allowed to remain even when the T-bar is not being used for snow fencing.

Figure 6:
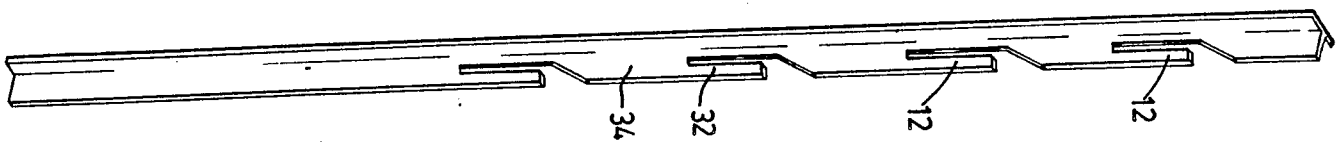
FIG. 6 shows a general view of another post incorporating cleats for supporting tape.

In the FIG. 6 embodiment the post 30 has a plurality of cleats 32 cut out from its leg portion 34, but this is a less strong structure than that of FIG. 1.

Figure 3:
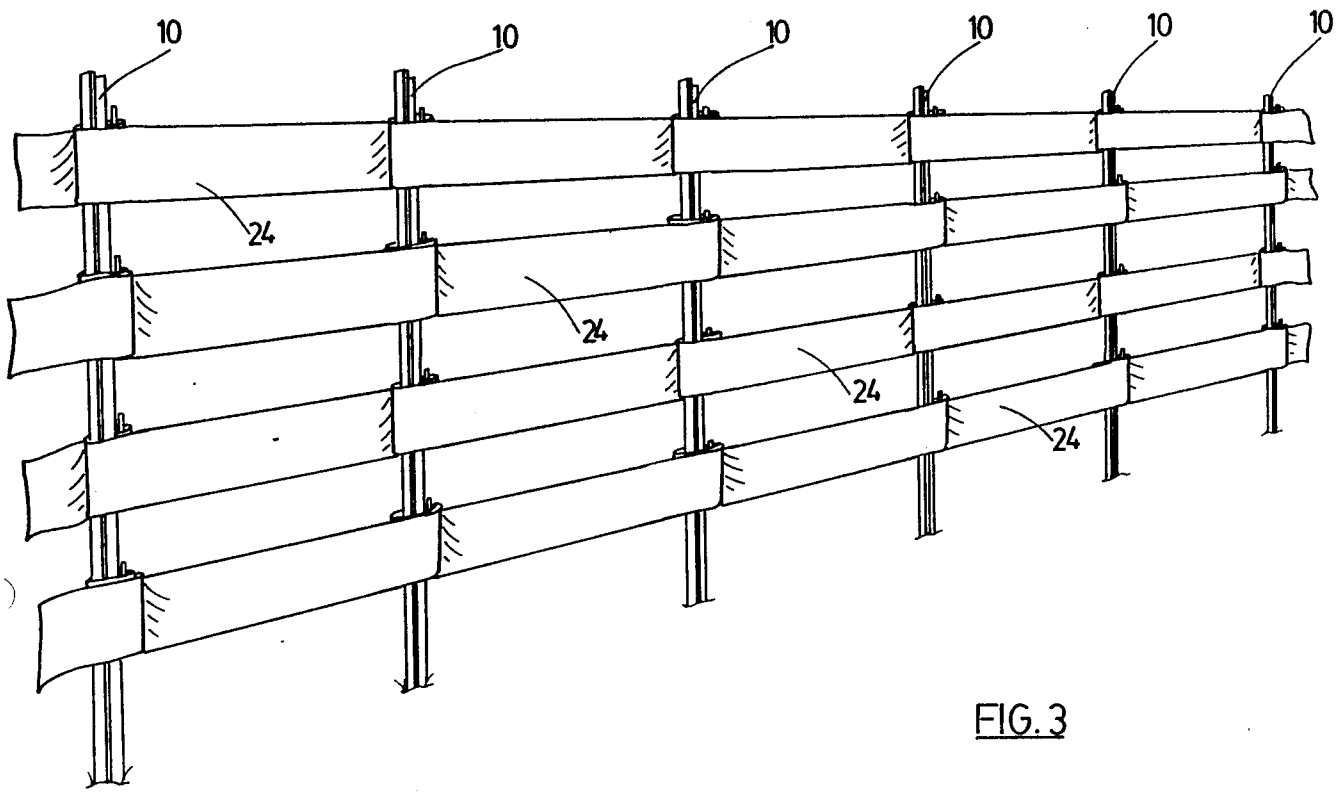
FIG. 3 is a general schematic view of a fence, having alternate upper and lower tapes reverse wrapped.

Referring to FIG. 3, a series of posts 10 form a fence line, having four rows of slats 24 of plastic tape 25 secured in tensioned relation to the respective cleat portions 12 of the posts 10. It will be observed that adjacent upper and lower slats 24 are oppositely handed, in relation to their attachment to the posts 10.

Thus, referring to FIG. 4, a bight 26 formed in the ribbon 25 is taken around the "back" of post 10, i.e., across the back of main flange 14, and is brought around the post and hooked over the cleat 12. The "back" of the post may be either the windward or leeward side of the post.

The on-going portion of single tape 25 emerging from the bight is led around "front" of post 10 to overlap the loop 26 where it wraps the cleat 12. The "front" of the post is the other of the windward or leeward sides. T-bars facilitate installation of the ribbons, and also enhance the maintenance of tension, due to the self binding effect of the loop wrap around. T-bars are generally supplied with apertures in their legs for the slinging of fence wire.

Simple manipulation of tape 25 and the preceding slat portion 24 can effect tensioning of the preceding slat portion 24; and maintenance of a light tension on the ongoing portion of ribbon 25 helps to lock the bight 26 and sustain the slat 24 in tensioned relation. It will be appreciated that the torsion forces acting on post 10, due to the direction of wrapping and tension forces of the ribbon 25 are counter-clockwise, as represented by arrow 27.

In the FIG. 5 embodiment the direction of wrap of the bight is reversed, as may be used for an upper or lower slat thus leading to the generation of clock-wise torque forces acting on post 10 as a consequence of the tension of slat 24 and ribbon 25, as represented by arrow 28.

It will be appreciated that the system is susceptible of a number of variations. For instance, the ribbon 25 may be secured and tensioned by being looped on alternate posts, and merely lie behind ears 12 in some instances.

In general terms, a six inch wide ribbon, carried on four cleats located at twelve inch centers, of a seven-foot post, having a two foot ground penetration portion, with the lowermost cleat located about three feet from the post end, will provide a nominal four foot fence, in combination with the subject ribbon 25. The posts are generally located at ten to fifteen foot intervals. The selection of ribbon width is predicated upon a number of facts, including balancing of labour costs against material cost, and effectiveness.

The ribbon 25, being generally of reclaimed or virgin plastic, has sufficient flexibility to readily wrap the posts in frictional engaging relation, and sufficient strength and stiffness to act as fence slats 24, to produce the requisite local air turbulence for snow fall out. It will be understood that low temperature durability also is a desirable characteristic, and is essential in harsh northern climates.

An eight foot fence post with five cleats 12, for the provision of five ribbon slats, will result in a nominal five foot fence, when a six-inch ribbon with a six-inch clear interval is provided.

A nine-foot post with six slat positions will result in a nominal six foot fence.

The subject fence lends itself both to ready erection and ready dissassembly. An adult of normal stature and strength can readily "string" and tension a subject fence single handed.

In addition to the recited system, it is contemplated that a single loop-back about the cleat 12 may be employed in some instances. This, however, then applies the fence tensioning force directly as a transverse bending moment to the cleats 12, and does not serve to provide an overlying portion to lock the ribbon effectively.

The use of ribbons in a preferred range of five to twenty-five mils thick is contemplated. However, certain high strength films, including extruded and oriented plastic films, as well as woven fabric, including low cost natural fibers can be utilized in practicing the invention, which may lie outside the stated gauge range.

While disclosed in relation to snow fencing, it will be appreciated that the low material and labour costs associated with the subject fence enable its use economically in prairie areas, both for snow storage, to limit drifing and build up on ground snow holding capacity, and also on beaches and fields to stabilize against sand and dust erosion.

I claim:

1. A fence comprising a plurality of spaced apart vertical posts driven into the ground and a plurality of horizontal vertically spaced apart slats of a tape of flexible material connected to the posts comprising the improvement wherein:

each post comprises an elongate T-bar having a plurality of vertically spaced apart cleats, each cleat connected at one end to the post generally parallel with the member and oriented such that there is a slot which opens upwardly between the member and the cleat;

a ribbon/tape of the material is folded to form an apex from which two longitudinal portions of the material extend and wherein a cleat of each post engages the apex of the bight interiorly and the two portions are wrapped around the T-bar such that a first portion is wrapped to overlap a second portion to connect the slat to the post and the second portion passes through the slot and wraps at least once around the post and the first and second portions horizontally extend to and are connected to other posts in similar manner respectively whereby the tension of slats is determined by friction between the first and second portions on the cleat and wrapped around the T-bar.

2. The fence of claim of 1 wherein the posts are substantially aligned and the first portion is wrapped about once around the post and the second portion is wrapped about one and a half times around the post.

3. The fence of claim 1 wherein there is a plurality of vertically spaced apart slats and the portions of alternating vertically spaced slats are wrapped one of clockwise or counterclockwise around the member and remaining slats are wrapped the other of clockwise or counterclockwise around the member.

4. The fence of claim 1 wherein each slot is of a height at least as great as about a width of the portion of material wrapped therethrough.

5. The fence of claim 4 wherein slats are of about equal width to each other and about equal to a vertical space between vertically neighboring slats.

6. The fence of claim 4 wherein each slat is about six inches wide.

7. The fence of claim 1 wherein each cleat comprises an upstanding leg connected to the T-bar by attachment means.

8. The fence of claim 7 wherein the attachment means comprises a nut and bolt adapted to cooperate with an aperture in a leg of the T-bar.

9. The fence of claim 8 wherein each cleat further comprises a leg having a hook adapted to fit an aperture in the leg of the T-bar.

10. The fence of claim 9 in which the hook and bolt are spaced apart to be located in adjacent apertures of the T-bar.

11. The fence of claim 8 in which a plurality of cleats are connected to a spacing bar and located thereon such that each bolt is locatable in an aperture of the T-bar.

12. The fence of claim 1 wherein the material is plastic having a thickness of from about five to twenty-five mils.

13. A method of erecting a fence having spaced apart vertical posts and vertically spaced apart horizontal slats of flexible tape, each post comprising a T-bar having a windward side and a leeward side, cleats being mounted thereon in vertically spaced relationship, each cleat comprising an upstanding leg parallel with the T-bar and spaced therefrom by a web to form an upwardly open slot, comprising the steps of:

(1) looping a portion of the tape over on itself to form a first bight having an apex;

(2) engaging the apex of the bight with a cleat of a post whereby the cleat is received within the bight and a first of two portions of tape emerging from the apex passes through the slot;

(3) wrapping both portions of the tape around the T-bar such that the first portion is wrapped directly against the T-bar and the other portion overlaps a part of the first portion;

(4) extending one of the portions the tape toward an adjacent post;

(5) tensioning the tape and repeating steps 1, 2 and 3 to form a slat between the posts.

* * * * *